United States Patent [19]

Cook

[11] Patent Number: 4,596,588

[45] Date of Patent: Jun. 24, 1986

[54] SELECTED METHODS OF REFLUX-HYDROCARBON GAS SEPARATION PROCESS

[75] Inventor: G. Dennis Cook, Humble, Tex.

[73] Assignee: Gulsby Engineering Inc., Humble, Tex.

[21] Appl. No.: 722,592

[22] Filed: Apr. 12, 1985

[51] Int. Cl.[4] ..... F25J 3/02

[52] U.S. Cl. ..... 62/26; 62/28; 62/30; 62/39

[58] Field of Search ..... 62/28, 25, 26, 27, 29, 62/30, 33, 38, 39

[56] References Cited

U.S. PATENT DOCUMENTS 3,675,434 7/1972 Crawford et al. ..... 62/23

4,203,741 5/1980 Bellinger et al. ..... 62/23

*Primary Examiner*—Frank Sever

*Attorney, Agent, or Firm*—Ranseler O. Wyatt

[57] ABSTRACT

A process for the separation of components of a normally vapor stream containing methane and heavier components by a cryogenic process. This process consisting of cooling the inlet stream, separating the remaining vapor from the resulting liquid which is directed into a distillation column. The vapor is expanded and produced liquids are fed into the distillation column. The expanded vapor stream is contacted with a reflux obtained from a specific source resulting in a secondary reflux which is directed to the top of the distillation column. The origin of the reflux stream is determined by the specific application requirements.

3 Claims, 3 Drawing Figures

SELECTED METHODS OF REFLUX-HYDROCARBON GAS SEPARATION PROCESS

BACKGROUND OF THE INVENTION

The advantages of reflux during distillation are well known. Many different processes have been used for hydrocarbon gas separation by means of cryogenics. Some of these processes use unusual methods of reflux to enhance the recovery of desirable components. Heat is supplied through a combination of feed heater, side and bottom reboilers to supply the vapors necessary to demethanize the product. The purpose of this invention is to provide a process wherein one of three specific methods of reflux is used. This process allows higher recovery levels to be achieved than possible with conventional methods or reducing the consumption of utilities while maintaining comparable recovery. The selection of the specific reflux source is determined by design requirements for the particular application.

REFERENCES

The patent to Jerry G. Gulsby and G. Dennis Cook, issued in 1984, U.S. Pat. No. 4,453,958, and the patent to Jerry G. Gulsby, issued in 1984, U.S. Pat. No. 4,464,190 and the patent to Jerry G. Gulsby issued in 1981, U.S. Pat. No. 4,251,249 are believed to be the closest references. Other patents in this field are Randall, U.S. Pat. No. 3,702,541; Swearingen, U.S. Pat. No. 3,747,358; Agnibotri, U.S. Pat. No. 4,203,742 and Cambell et all U.S. Pat. No. 4,278,457. These references, however, do not show the rectification process employed by Applicant to provide a secondary reflux.

SUMMARY OF THE INVENTION

The method of separation of components of a volatile gas containing methane and heavier components, wherein the gas is cooled and divided into liquid and vapor fractions. The liquid being directed into a distillation tower at a midpoint while the vapors are expanded to an intermediate pressure and directed into the bottom section of a two stage separator. The liquids formed by the pressure reduction are separated from the remaining vapor and directed into the distillation tower at a point above the previous feed. The remaining vapors rise into the upper portion of the two stage separator to be contacted with a liquid obtained from a specified reflux source.

This contact results in the formation of a secondary reflux stream which is then directed into the distillation column near the top. Heat is applied to the distallation column selectively through a combination of feed heaters and reboilers. The specified reflux is obtained from one of the following sources: (a) compressing and cooling the distillation column overhead vapor; (b) compressing and cooling the combined two stage separator vapor and distillation column overhead vapor; (c) cooling a separate inlet vapor stream.

The design requirements will dictate which of the above methods should be ksed to provide the reflux stream.

If only one inlet stream is available and it is desirable to operate the distillation column at a pressure substantially below the two stage separator operating pressure then method (a) should be selected.

If only one inlet stream is available and it is desireable to operate the distillation column and the two stage separator at essentially the same pressure and the inlet stream contains more than six volume percent of ethane then method (b) should be selected.

If there are two inlet streams available and one of these is lower in molecular weight, then method (c) should be selected.

DESCRIPTION OF PREFERRED EMBODIMENTS

Figure 1:
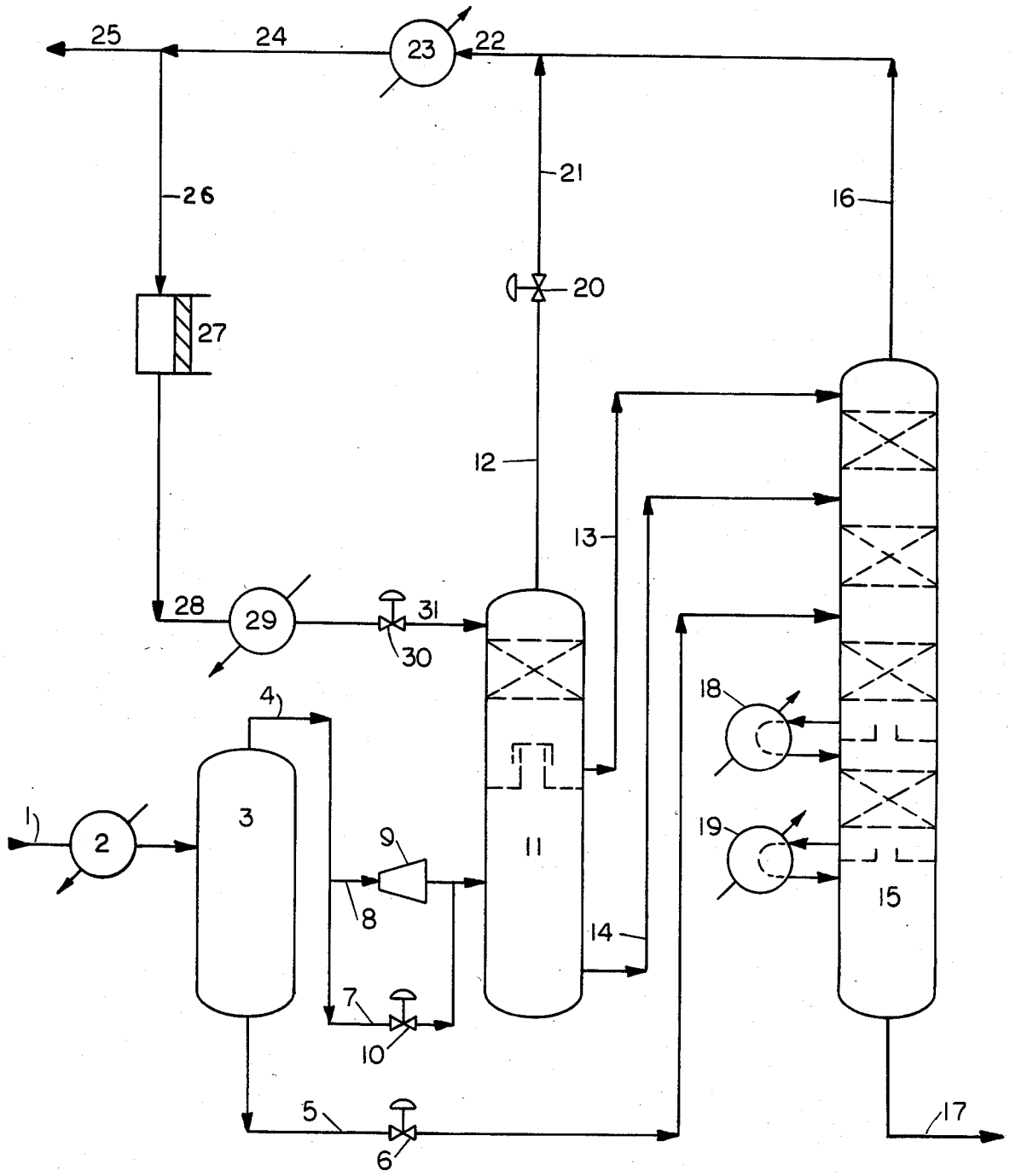
FIG. 1 is a diagramatic view of the process, illustrating the rectification using the distillation tower overhead as the reflux source.

Referring to the drawings, the numeral 1 indicates the primary feed which enters heat exchanger 2, where the stream is cooled before entering vesel 3, where the vapor and liquid fractions are separated into streams 4 and 5 respectively. Stream 5 passes through valve 6 prior to entering the distillation column 15. The vapor stream 4 is selectively divided into streams 7 and 8. Stream 7 enters valve 10 for pressure reduction control while stream 8 enters the expander 9 where the pressure and temperature are reduced. The two streams recombine prior to entering the lower portion of the two stage separator 11, where the liquid condensed by the pressure reduction is separated from the remaining vapor. The liquid is removed from the separator as stream 14 and is directed into the distillation column 15 at a mid point.

The reflux stream number 28 is cooled in heat exchanger 29 prior to entering valve number 30 where the pressure is reduced before entering the top section of the two stage separator 11 as stream 31.

The liquid fraction of stream 31 travels down through the top section of the two stage separator 11 contacting vapor from the bottom section absorbing heavier components from the vapor while vaporizing some of the lighter components. The resulting liquid is used as stream number 13 to provide reflux for the distillation column 15. The vapor portion of stream 31 combines with the vapor remaining after contact with the reflux liquid to form stream 12.

Heat exchange units 18 and 19 are used to selectively heat the liquids in the distillation column.

In the form shown in FIG. 1; Stream 12 enters valve 20 for pressure reduction and joins the distillation column overhead stream 16 to form stream 22 which is warmed in heat exchanger 23 to form stream 24, Which is then divided into stream 25, the residue gas stream, and stream 26 which enters compressor 27 to then become stream 28 which passes through the heat exchanger 29 and enters the two stage separator through stream 31, where it is again treated and the vapor enters stream 12.

Figure 2:
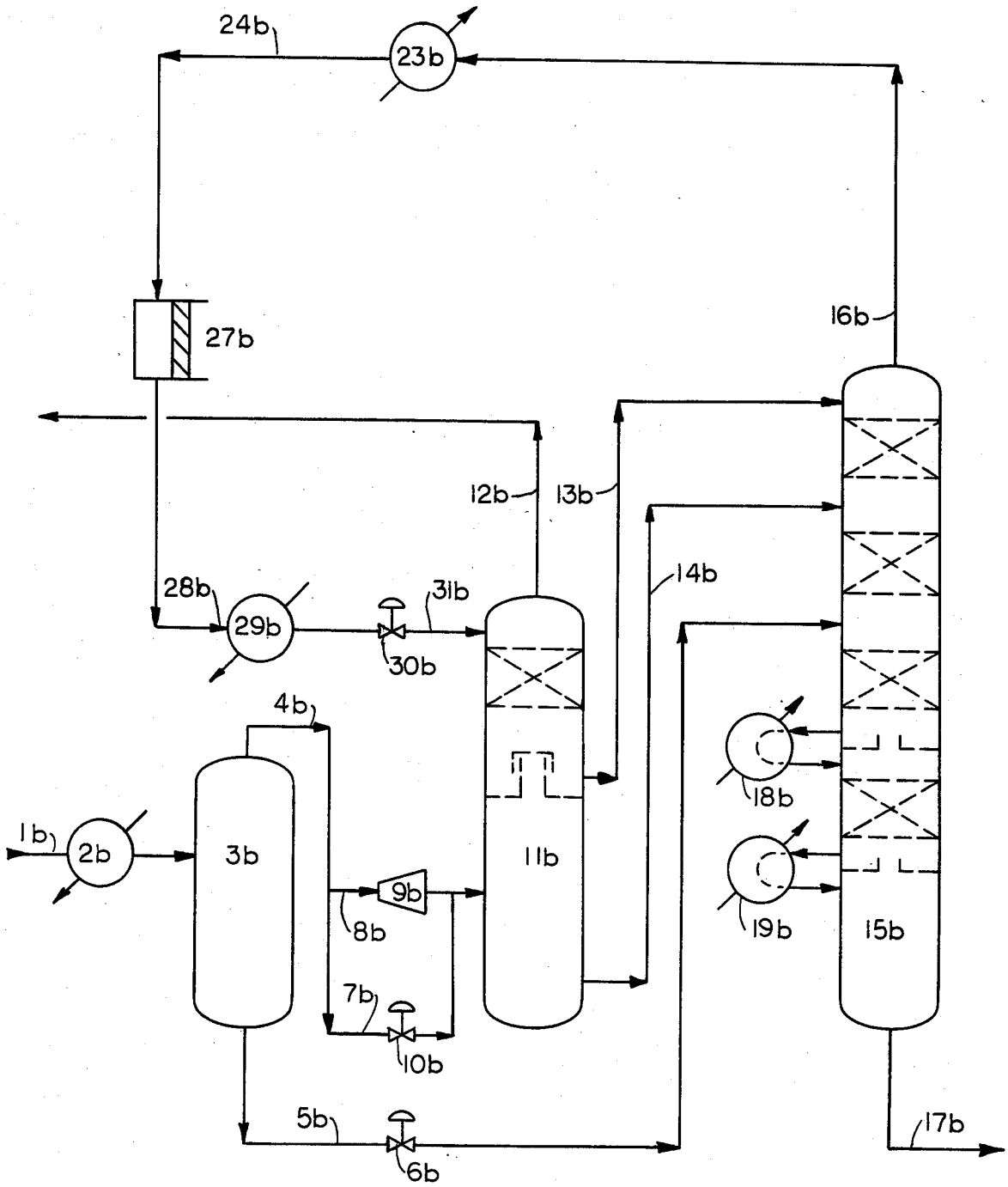
FIG. 2 is a diagramatic view of the process, illustrating a modification of the rectifying process using the combined distillation tower overhead vapor combined with the two stage separator vapor as the reflux source.

In the form shown in FIG. 2; Stream **12*b* exits the two stage separator as the residue gas stream. Stream 16*b* is warmed in heat exchanger 23*b* to become stream 24*b* which enters compressor 27*b*. It then becomes stream 28*b* which is treated in the heat exchanger 29*b*** and becomes stream 31*b* which enters the two stage separator and is again treated and the vapor enters stream 12*b* and is discharged.

Figure 3:
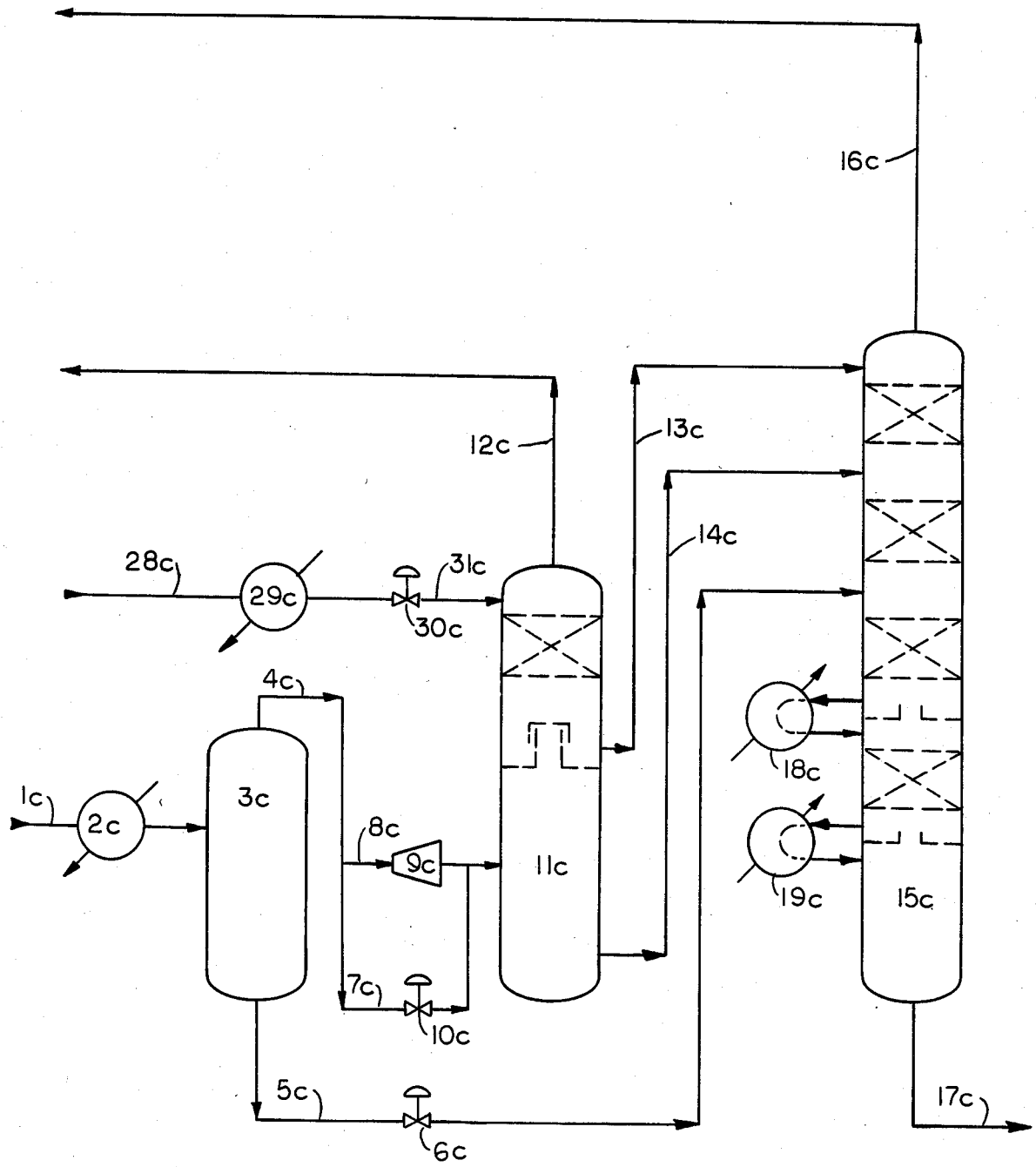
FIG. 3 is a diagramatic view of the process, illustrating a second modification of the rectifying process using a separate inlet vapor stream as the reflux source.

In the form shown in FIG. 3; Streams 12*c* and 16*c* are discharge streams while a separate inlet gas stream is used as stream 28*c* to be treated in the heat exchange 29 and enters the two stage separator for treatment with the vapors combining with the vapors in the separator thus forming stream 12*c*.

What I claim is:

1. A process for the recovery of components of volatile gas containing methane and heavier components wherein one of three specific methods of reflux is used the selection being dependent upon the specific requirements of rectification, in each instance said process consisting of introducing a primary stream of feed gas under pressure into a heat exchange unit to lower the temperature of said gas stream, then dividing the stream into two streams, the first of said streams being primarily vapors being directed through an expansion device, then lowering the pressure and temperature thereof and then passing same through a divider formed in the lower section of a two stage separator, said divider separating the vapors and liquid, then discharging the liquids directly into the distillation column at a mid point and discharging the vapors into the upper section of said two stage separator for combination with reflux obtained from a secondary feed gas stream, said reflux stream extracting desirable components from the vapors and forming a secondary reflux liquid stream, which then enters the distillation column at the top and the vapors combining with vapors from the two stage separator forming a vapor stream to be discharged from said two stage separator.

2. The process taught in claim 1 wherein the reflux stream is obtained from a compression of the distillation tower overhead, thus allowing the two stage separator to operate at a pressure substantially higher than that of the distillation tower, obtaining a secondary reflux stream from a portion of vapors in the two stage separator which are passed through a heat exchange before reentering the two stage separator for further treatment.

3. The process taught in claim 1 wherein the selection of a specific method is made where the reflux stream is obtained from the combined two stage separator overhead and the distillation tower overhead.

* * * * *